US012515252B2

(12) United States Patent
Kintscher et al.

(10) Patent No.: US 12,515,252 B2
(45) Date of Patent: Jan. 6, 2026

(54) DEVICE AND METHOD FOR PRODUCING HOT-ROLLED METAL STRIPS

(71) Applicant: SMS group GmbH, Düsseldorf (DE)

(72) Inventors: Björn Kintscher, Velbert (DE); Kerstin Spill, Netphen (DE); Christoph Klein, Kreuztal (DE); Gokhan Erarslan, Düsseldorf (DE); Jens Kreikemeier, Lennestadt (DE)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 18/031,038

(22) PCT Filed: Oct. 12, 2021

(86) PCT No.: PCT/EP2021/078174
§ 371 (c)(1),
(2) Date: May 2, 2023

(87) PCT Pub. No.: WO2022/079027
PCT Pub. Date: Apr. 21, 2022

(65) Prior Publication Data

US 2023/0372998 A1 Nov. 23, 2023

(30) Foreign Application Priority Data

Oct. 13, 2020 (DE) ..... 10 2020 212 914.2
Oct. 7, 2021 (DE) ..... 10 2021 211 339.7

(51) Int. Cl.
*B22D 11/12* (2006.01)
*B21B 1/26* (2006.01)
(Continued)

(52) U.S. Cl.
CPC ..... *B22D 11/1206* (2013.01); *B21B 1/26* (2013.01); *B22D 11/1213* (2013.01);
(Continued)

(58) Field of Classification Search
CPC . B21B 1/466; B22D 11/1206; B22D 11/1213; B22D 11/124; B22D 11/16; B22D 11/22
See application file for complete search history.

(56) References Cited

U.S. PATENT DOCUMENTS 5,150,597 A * 9/1992 Sekiya ..... B21B 1/26 72/229
5,276,952 A 1/1994 Thomas et al.
(Continued)

FOREIGN PATENT DOCUMENTS

DE 19953252 A1 5/2001
DE 102008020412 A1 2/2009
(Continued)

*Primary Examiner* — Keith Walker
*Assistant Examiner* — Jacky Yuen
(74) *Attorney, Agent, or Firm* — Smartpat PLC

(57) ABSTRACT

A device for producing hot-rolled metal strips has a casting machine that produces and transports slabs in a transport line of the casting machine. A rolling mill forms the slabs into corresponding metal strips during transport along a transport line of the rolling mill. A combination transport and temperature-influencing device is arranged between the casting machine and the rolling mill transports the slabs at least along the transport line of the rolling mill, feeds the slabs to the rolling mill and sets the temperature of the slabs to a rolling temperature. A surface device is arranged between the casting machine and the combination transport and temperature-influencing device and processes and/or treats and/or inspects at least one of the surfaces of the slabs. A temperature-influencing device is arranged between the casting machine and the combination transport and temperature-influencing device and modifies the temperature of the slabs.

11 Claims, 4 Drawing Sheets

(51) Int. Cl.

| | |
|---|---|
| ***B21B 1/46*** | (2006.01) |
| ***B22D 11/124*** | (2006.01) |
| ***B22D 11/128*** | (2006.01) |
| ***B22D 11/16*** | (2006.01) |
| ***B22D 11/22*** | (2006.01) |

(52) U.S. Cl.

CPC ..... *B22D 11/124* (2013.01); *B22D 11/128* (2013.01); *B22D 11/16* (2013.01); *B22D 11/22* (2013.01); *B21B 1/466* (2013.01)

(56) References Cited

U.S. PATENT DOCUMENTS

| | | | | |
|---|---|---|---|---|
| 5,467,519 | A | 11/1995 | Tippins et al. | |
| 6,436,205 | B1 | 8/2002 | Behrens et al. | |
| 7,513,026 | B2 | 4/2009 | Thomanek | |
| 2002/0104597 | A1* | 8/2002 | Frank | C21D 8/0226 148/547 |
| 2008/0028813 | A1 | 2/2008 | Arvedi et al. | |
| 2010/0116380 | A1 | 5/2010 | Seidel et al. | |
| 2010/0147484 | A1 | 6/2010 | Rosenthal et al. | |
| 2012/0160377 | A1* | 6/2012 | Seidel | C21D 8/021 72/201 |
| 2016/0101450 | A1 | 4/2016 | Linzer et al. | |
| 2017/0298491 | A1* | 10/2017 | Toschi | C21D 7/13 |
| 2022/0339695 | A1 | 10/2022 | Neumann et al. | |

FOREIGN PATENT DOCUMENTS

| | | | | | |
|---|---|---|---|---|---|
| EP | 0662358 | A1 | | 7/1995 | |
| EP | 0808672 | A1 | | 11/1997 | |
| EP | 808672 | B1 | | 12/2001 | |
| EP | 2462248 | A1 | | 2/2011 | |
| JP | S52131919 | A | | 11/1977 | |
| JP | 03081012 | A | * | 4/1991 | B21B 1/466 |
| JP | H05208216 | A | | 8/1993 | |
| JP | H1034222 | A | | 2/1998 | |
| JP | 2000061588 | A | | 2/2000 | |
| JP | 2019155385 | A | | 9/2019 | |
| WO | 9323182 | A1 | | 11/1993 | |
| WO | 2000059650 | A1 | | 10/2000 | |
| WO | 2009012963 | A1 | | 1/2009 | |
| WO | 2009027045 | A1 | | 3/2009 | |
| WO | 2019215114 | A1 | | 11/2019 | |

* cited by examiner

T Temperature
G Geometric dimensions
t Dwell time
v Speed
+/- On/off circuit
Q Heat flow (heating/cooling power)
Level 3 = Level 3
T_soll = T_target

DEVICE AND METHOD FOR PRODUCING HOT-ROLLED METAL STRIPS

CROSS-REFERENCE TO RELATED APPLICATION

This application is a national stage application, filed under 35 U.S.C. § 371, of International Patent Application No. PCT/EP2021/078174, filed on 12 Oct. 2021, which claims the benefit of German Patent Applications No. 10 2020 212 914.2, filed 13 Oct. 2020 and No. 10 2021 211 339.7, filed 7 Oct. 2021.

TECHNICAL FIELD

The disclosure relates to a device and a method for producing rolled metal strips, preferably hot-rolled metal strips.

BACKGROUND

In continuous casting, a continuous casting process for producing semi-finished products such as slabs made of ferrous and non-ferrous alloys, the metal is poured through a usually cooled ingot mold and discharged with a solidified shell and still liquid core downwards, sideways or in an arc. Subsequently, usually after cooling in a slab storage area, the slabs are fed into a rolling mill, where they are formed into metal strips.

The technical structure and requirements of continuous casting/rolling mills differ depending on whether they are designed to produce so-called "thin slabs" in a thickness range of approximately 40 to 110 mm, "medium slabs" in a thickness range of approximately 110 to 200 mm, or "thick slabs" with greater thicknesses. A system for continuous casting and further treatment of thin slabs can be found, for example, in EP 0 808 672 A1.

The systems are typically designed for one production focus and thus have little or no flexibility for alternative products. Thus, the casting thickness, that is, the alloy-specific production of a thin slab or medium slab, is related to an alloy-specific casting speed, wherein not all alloys are suitable for the production of a thin slab. Depending on the subsequent use of the product, the target thickness and the process control vary. For example, temperature control prior to the start of the rolling process, between different rolling processes and after finish rolling are essential process steps for setting material properties. For coupled casting/rolling processes, the available assemblies determine the possible process steps.

In order to increase the product range in conventional hot strip mills, it is known not to form the material to be rolled from the casting heat, but to cool it completely or partially in a slab storage area, which results in a technological separation between the casting and the further processing, in particular the rolling, of the slabs. However, this results in disadvantages in terms of mechanical engineering, energy and logistics.

SUMMARY

One object of the disclosure is to provide an improved device along with an improved process for the production of rolled metal strips, preferably hot-rolled metal strips, in particular to increase the processable product range without technological separation between casting and rolling.

The task is solved by a device as disclosed and claimed and a method as disclosed and claimed. Advantageous further embodiments follow from the subclaims, the following description and the description of preferred exemplary embodiments.

The device is used for the production of rolled, in particular hot-rolled metal strips. Products made of a metal, in particular a metal alloy, preferably steel, are cast and processed. The device is preferably designed for the production and further treatment of medium slabs, with a thickness in the range of 90 to 250 mm, preferably 110 to 200 mm.

The device has a casting machine, which is designed to produce and transport slabs in a transport line of the casting machine. The casting machine is preferably implemented as a vertical curved machine, also known as an "arc caster." However, it can be realized in other manners as long as it provides a casting strand that can be subsequently cut into slabs and further processed.

The device further comprises a rolling mill, which is designed to form the slabs into corresponding metal strips by rolling during the transport along a transport line of the rolling mill. The two transport lines—transport line of the casting machine and transport line of the rolling mill—may coincide or differ, in the latter case requiring corresponding transverse transport of the slabs on the way from the casting machine to the rolling mill. In the usual manner, the rolling mill comprises one or more rolling mill stands, preferably each of 4-high design with two working rolls and two backup rolls, and can be operated in reversing or tandem mode. The rolling mill can comprise or be designed as a roughing mill and/or finishing mill. Particularly preferably, the rolling mill is a hot rolling mill, in which the slabs are formed at least partially from the casting heat, that is, in such case there is no complete cooling of the slabs after casting on the way to the rolling mill.

The device further comprises a combination transport and temperature-influencing device (also abbreviated herein as "CTT"), which is arranged between the casting machine and the rolling mill and which is designed to transport the slabs to or along the transport line of the rolling mill, to feed the slabs to the rolling mill and to set the temperature of the slabs to a (suitable) rolling temperature. The CTT is primarily used to logistically feed the slabs to the rolling mill at the necessary temperature, which generally depends on process parameters such as the alloy. The term "temperature" in this connection comprises not only absolute temperatures, such as surface and core temperature, but also temperature distribution(s).

It should be noted that designations of spatial relationships, for example "between," "vertical," "horizontal," "above," "below," "upstream," "downstream," "in front of," "behind," etc., are clearly defined by the structure and intended use of the device along with the direction of transport of the casting strand or slabs, as the case may be. If the CTT, as defined above, is arranged between the casting machine and the rolling mill, it includes, for example, information that a slab produced by the casting machine will be transported through the CTT and then through the rolling mill for forming into the desired metal strip.

The device further comprises a surface device, which is arranged between the casting machine and the CTT and which is designed to process and/or treat and/or inspect at least one of the surfaces of the slabs. For example, the surface device can comprise material-removing surface processing, which is used, for example, to produce products with special surface requirements. Such special requirements on product surfaces are made, for example, for use as an automotive outer skin, electrical steel strip or for optical applications. Alternatively or additionally, the surface device can be designed to remedy any surface defects resulting from the casting process, such that they are removed before further process steps such as rolling take place. This means that, in such a case, it is a surface treatment that goes beyond mere scale removal. Alternatively or additionally, the surface device can comprise an inspection device, which is designed to detect surface properties of the slabs by means of contact or on a non-contact basis.

The device further comprises a temperature-influencing device, which is arranged between the casting machine and the CTT and which is designed to modify the temperature of the slabs. The temperature-influencing device is used in particular in the production of crack-sensitive products, for example microalloyed steels. If such alloys were introduced into the CTT immediately after the casting process, undesired precipitation of microalloys in the layers close to the edges could occur, leading to cracking or other quality defects in subsequent steps.

The slabs do not have to pass through each of the above stations between the casting machine and the CTT. Rather, the stations may be integrated into or removed from the production process based on the product or application. Thus, slabs can pass through either the surface device or the temperature-influencing device, or neither of the two. In such a case, the two stations do not have to be arranged one behind the other in the same line; rather, they may be installed in parallel, wherein a corresponding routing decision is made for the slabs, or they may enter the line as needed. Alternatively, a parallel or inline arrangement can be provided as required.

The device described above for producing metal strips, in particular hot-rolled metal strips, can be used with a high degree of flexibility in terms of the product range and at the same time requires a minimum input of energy. In this manner, the device eliminates conventional limitations of the product range, without interrupting the production process. The device is capable of processing both micro-alloyed steels and highly soft material grades or material grades intended for special surface qualities, fully, without interruption and without technological limitation. Depending on the system layout, highly compact arrangements and/or production modes may be realized.

Preferably, the temperature-influencing device comprises a combination heating and cooling device having a heating device and cooling device, such that the slabs may be selectively heated or cooled by the temperature-influencing device. Thereby, the heating device preferably comprises one or more inductive heating devices. The cooling device can be designed for rapid cooling of the slabs by applying a coolant, preferably cooling water. The heating device and cooling device may be installed one behind the other or in parallel, preferably forming a common assembly. A temperature-influencing device constructed in this manner makes it possible, in a compact and flexible manner, to quickly bring the surface temperature of the slabs to be treated into a desired temperature window or out of a disadvantageous temperature window, without the need for intermediate storage and complete cooling in a slab storage area. The core heat can be at least partially retained and used later for rolling.

Preferably, the surface device is designed to process at least one surface of the slab(s) by grinding and/or milling and/or scarfing. Surface processing is performed on at least one surface of the slab to be processed, wherein preferably both the top and bottom sides of the slab as well as the longitudinal edges are processed. The material removal per surface is, for example, in the range of 0 to 10 mm, preferably in the range of 1 to 3 mm. Surface processing preferably takes place at a slab surface temperature of greater than 600° C., more preferably greater than 900° C.

The CTT can be in a variety of possible configurations. It preferably comprises: one or more roller tables; and/or one or more thermal insulation devices; and/or one or more inductive heating elements; and/or one or more furnaces; and/or one or more slab discharge devices for discharging slabs from the transport line of the casting machine and/or transport line of the rolling mill; and/or one or more slab feed devices for feeding slabs into the transport line of the casting machine and/or transport line of the rolling mill.

The structure of the CTT is preferably variable with regard to the type of temperature influencing and logistics. In a simple variant, the CTT comprises a roller hearth furnace that performs both temperature equalization and slab transport. In an alternative variant, the CTT comprises a roller table as a transport element, preferably with thermal insulation device, in combination with at least one, preferably a plurality of inductive heating elements. Alternatively or additionally, the CTT can have a plurality of walking beam furnaces arranged one behind the other, whereby a highly compact structure can be achieved. Furthermore, the CTT can act as an interface between the technologically separate casting machine and rolling mill. For this purpose, technical means (roller tables, slab ferries, walking beams, etc.) may be installed in order to transfer the slabs from the transport line of the casting machine to the transport line of the rolling mill. This flexible arrangement also allows slabs from other sources to be fed into or discharged from the corresponding transport line.

In accordance with one exemplary embodiment, the transport line of the casting machine and the transport line of the rolling mill are identical.

In accordance with an alternative exemplary embodiment, the transport line of the casting machine and the transport line of the rolling mill differ, wherein it preferably runs in parallel, which allows the system to be realized in a particularly compact manner.

In both cases, the surface device, temperature-influencing device and at least parts, up to the entire CTT may be positioned one behind the other in one and the same transport line.

Preferably, multiple routes are provided, which implement different process lines for the slabs, at least in sections. Thereby, the surface device may be arranged in a first route and the temperature-influencing device may be arranged in a second route and is designed in such a manner that the slabs pass through either the surface device or the temperature-influencing device, but not both. Thereby, a third route can also be provided, which acts as a bypass in that the slabs bypass, that is, skip, both the surface device and the temperature-influencing device and can be introduced into the combination transport and temperature-influencing device immediately following casting. The route decision can be made on a batch-by-batch, product-by-product or slab-by-slab basis, depending on process parameters such as the alloy or temperature of the slabs, or depending on quality requirements resulting, for example, from the intended application of the rolled products.

Preferably, the rolling mill is a hot rolling mill, which is designed to form the slabs at least partially from the casting heat of the casting machine. In such a case, the overall design of the device is such that there is no complete cooling of the slabs after casting on the way to the rolling mill. In particular, there is no removal of the slabs to a slab storage area. The slab is largely "in motion" throughout. The production sequence is dictated by the production cycles of the casting machine.

In such a case, the device can be realized in a particularly compact and energy-saving manner, without thereby sacrificing flexibility. For this reason, the control device described below is preferably designed to feed the slabs cast by the casting machine to the rolling mill without intermediate storage in a slab storage area. Thereby, "intermediate storage in a slab storage area" is understood to mean any interruption in the process control of the slab(s) that results in substantially complete cooling of the slab(s), comprising the slab core, prior to rolling. Temperature reductions in the course of process control, such as in thermomechanical rolling, are not understood as intermediate storage.

Preferably, the device has a control device, which is designed to control the process control of the slabs as a function of measured and/or calculated process parameters, preferably comprising the alloy and/or temperature of the cast slabs.

The control device is connected in terms of signal technology to the components of the device to be controlled and/or read out, thus in particular to the casting machine, the surface device, the temperature-influencing device, the CTT and the rolling mill. Communication between the control device and the system components to be controlled and/or read out can be wired or wireless, digital or analog. The control device can receive and/or transmit corresponding signals (control signals, data, etc.) accordingly, wherein signal transport in one direction as well as in both directions falls under the term "communication" in this context. Thereby, the control device does not necessarily have to be realized by a central computing device or electronic control system; rather, decentralized and/or multi-level systems, control networks, cloud systems and the like are included. The controller can also be an integral component of a higher-level system control system, or can communicate with one.

The control device preferably comprises one or more process models or at least an interface to one or more process models. For example, the control device can communicate with a process model of the casting machine and a process model of the rolling mill. The control device is preferably designed to map the process control and the process parameters from the casting machine to the rolling mill. Thereby, relevant data, such as slab temperature or final rolling temperature, from the process model of the casting machine and the process model of the rolling mill are communicated to the control device. In this manner, data that determine the production steps and influence the corresponding settings of the stations may be obtained.

Preferably, the control device is designed to heat or cool slabs (in particular of a crack-sensitive alloy) by means of the temperature-influencing device in such a manner that the slab surface temperature before entering the combination transport and temperature-influencing device is outside a critical temperature range defined by a lower threshold value of preferably 600° C. and an upper threshold value of preferably 850° C. In such a case, the temperature-influencing device selectively heats or cools the slab passing through it, such that it is ensured that the slab surface temperature is outside the critical temperature range. This is preferably effected as a function of a measured or otherwise determined slab surface temperature upstream of the temperature-influencing device. If the control device determines, possibly in cooperation with a corresponding temperature sensor or calculation model, that the slab surface temperature at the inlet of the temperature-influencing device is above the upper threshold value or below the lower threshold value, temperature influencing by the temperature-influencing device is not necessary. If the slab surface temperature is within the critical temperature window, the slab is either heated or cooled by the temperature-influencing device, depending on the direction in which the slab can be brought out of the temperature window. If both directions are possible, the heating of the slab by the temperature-influencing device is preferred.

The object specified above is further achieved by a method for producing rolled metal strips, preferably hot-rolled metal strips, wherein the method is carried out with a device in accordance with one of the embodiments set forth above. The method comprises: Casting of a slab by means of the casting machine; transfer of the slab to the CTT; hot rolling of the slab in the rolling mill to a metal strip, wherein complete cooling of the slab does not take place after casting on the way to the rolling mill, preferably the slab temperature in its core does not fall below 600° C.

The technical effects, advantages along with embodiments described with respect to the device apply analogously to the method.

In accordance with an exemplary embodiment, following step a), as a function of one or more process parameters, the slab is transported immediately into the combination transport and temperature-influencing device, or temperature influencing is carried out by the temperature-influencing device and/or processing and/or treatment and/or inspection of at least one surface of the slab is carried out by the surface device.

Further advantages and features of the present invention are apparent from the following description of preferred exemplary embodiments. The features described therein may be implemented alone or in combination with one or more of the features set forth above, provided the features do not contradict one another. The following description of preferred exemplary embodiments is made with reference to the accompanying drawings.

BRIEF DESCRIPTION OF THE DRAWINGS

Preferred further embodiments of the invention are explained in more detail by the following description of the figure. The following are shown.

DETAILED DESCRIPTION

Preferred exemplary embodiments are described below with reference to the figures. In doing so, identical, similar or similarly acting elements are provided with identical reference signs in the figures, and a repeated description of such elements is partially omitted, in order to avoid redundancy.

Figure 1:
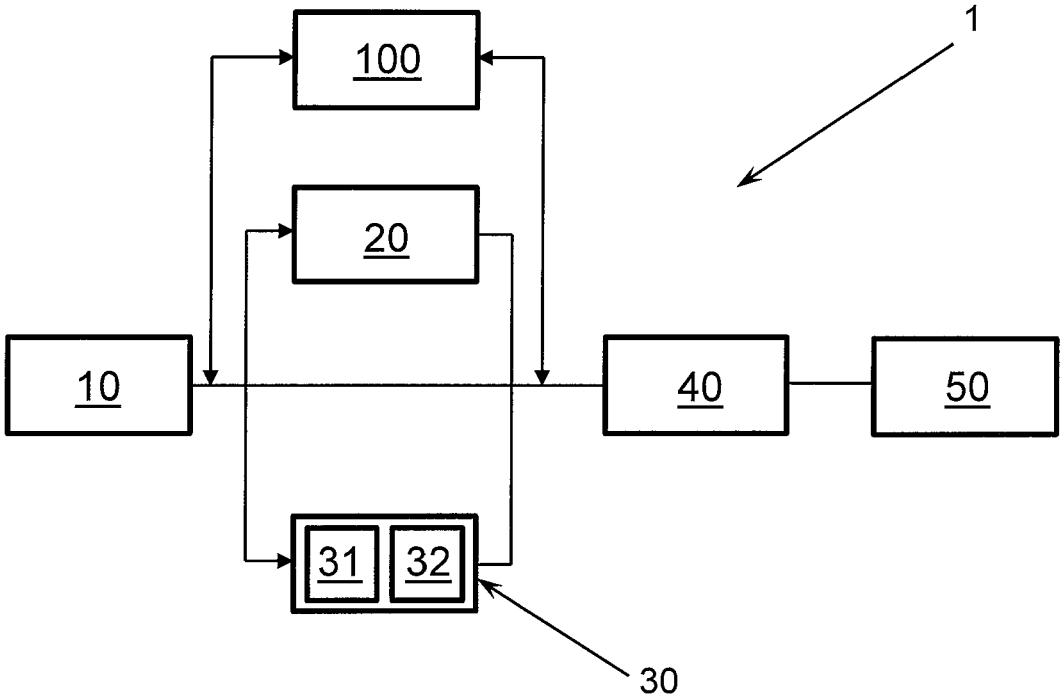
FIG. 1 a schematic illustration of a device for producing metal strips, in particular hot-rolled metal strips.

FIG. 1 schematically shows the basic structure of a device 1 for producing metal strips, in particular hot-rolled metal strips.

The device 1 comprises a casting machine 10, preferably implemented as a vertical curved machine, also referred to as an "arc caster." However, the casting machine 10 can be realized in other manners as long as it provides a casting strand that can be subsequently cut into slabs and further processed. Further, a plurality of casting machines 10 may be provided for casting a plurality of strands in parallel, or the casting machine 10 can be designed for casting a plurality of parallel strands.

Figure 2:
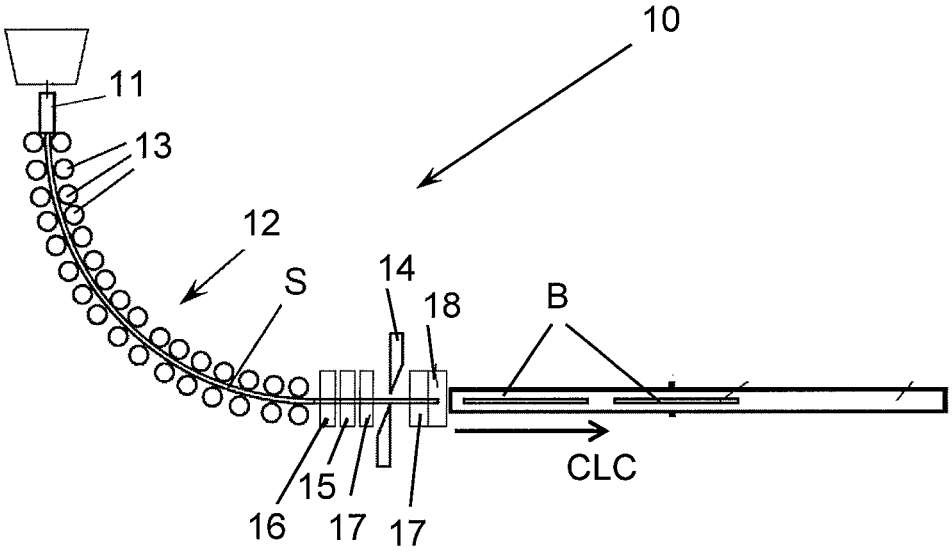
FIG. 2 a schematic illustration of a casting machine.

FIG. 2 schematically shows an exemplary casting machine 10. The molten metal to be cast is fed to an ingot mold 11 of the casting machine 10, for example from a casting ladle. The ingot mold 11 brings the molten metal into the desired slab shape as it solidifies gradually from the outside inward through the cooled ingot mold walls. The ingot mold 11 is preferably an ingot mold made of copper plates (or plates of a copper alloy, which may be coated), in the case of medium slabs with plane-parallel plates on the broad sides and narrow sides, which are adapted for a comparatively high casting thickness of, for example, 140 mm or more. If required by the casting thickness or casting radius, the copper plates can have a funnel-shaped contour and/or be curved in a direction of transport corresponding to the casting radius of a strand guide 12.

The casting strand S, which has not yet solidified, emerges downward from the ingot mold 11, then continues to be guided downward in the direction of transport along the strand guide 12, and then is deflected into the horizontal in a bending region while it gradually cools down. It should be noted that, in general, the direction of transport in the casting machine 10 does not denote a constant direction vector, but can depend on the strand or slab position, as the case may be, along the device 100. After being diverted to the horizontal, the casting strand S is conveyed along a transport line of the CLC casting machine.

The strand guide 12 comprises rollers 13 that transport the casting strand S and can be adjusted for thickness reduction in accordance with LCR ("liquid core reduction") or DSR ("dynamic soft reduction") in such a manner that the transport gap in which the casting strand is transported along the direction of transport gradually narrows. The strand guide 12 can be constructed in a segmental manner, for example by two or more curved segments similar in construction, which curved segments form a bending region of the strand guide 12. During transport, the casting strand S is cooled actively or passively, for example by splash water, within the framework a secondary cooling process, causing it to solidify gradually from the outside to the inside.

A shaping of the casting strand S caused by the casting machine 10, in particular a strand guide 12, is referred to as "original shaping"; in contrast to "forming," which refers to a shaping by a forming unit such as a rolling mill, for example.

The bending region of the casting machine 10 is followed by a straightening region, in which the casting strand S is brought into horizontal alignment. Rollers 13 are also provided here for guiding and transporting the casting strand S. One or more of the rollers 13 are drive rollers and drive the casting strand S forward in the direction of transport; other rollers 13 serve to guide and align the casting strand S. In this respect, the rollers 13 form means for driving and bending the casting strand S. Downstream of the casting machine, additional devices may be arranged.

The device 1 further has a cutting device 14, which is arranged in the transport line CLC behind the straightening region of the casting machine 10. The cutting device 14 is used to cut or divide, as the case may be, the casting strand S into slabs B. The cut is made along the slab thickness. "Slab thickness" is the dimension of the slab that is perpendicular to the extension of length and perpendicular to the width (in FIG. 2, perpendicular to the paper plane) of the slab. Thereby, the cutting device 14 is designed to cut the casting strand S during conveying, that is, during the movement of the casting strand S along the transport line CLC. Preferably, the cutting device 14 is a shear, in particular a pendulum shear. In this case, the shear is designed to track the transport movement of the casting strand S during the cutting operation, and one or more cutting blades cut the strand in a movement vertical to the casting strand S. In contrast to a flame cutter, a shear has the advantage that the cutting time is less than 5 minutes, preferably less than one minute, and no deburring of the slab head/foot is required.

The slabs B to be cast are preferably medium slabs, that is, slabs B with a thickness in the range of approximately 90 to 250 mm, preferably 110 to 200 mm. The casting speed is preferably in the range of 0.5 to 7 m/min, particularly preferably in the range of 1 to 4.8 m/min.

Upstream or downstream of the cutting device 14, a decoupler 15 can be provided, for example in the form of a dummy bar tilter, which is designed to be able to decouple the casting strand S from the process line if necessary, for example when starting up the system.

The device 1 can have one or more descaling devices 16 that are arranged upstream and/or downstream of the cutting device 14, depending on the configuration.

One or more heating devices 17, preferably inductive, using gas burners or operating electrically, can be installed at different positions in the process line. They can perform the object of the heating device 31, individually or in combination. Preferably, one or more heating devices 17 are located substantially directly upstream of the cutting device 14 or decoupler 15, as the case may be, if present, and/or downstream of the cutting device 14. On the one hand, heating devices 17 of this type may help to shorten the cooling section, and, on the other hand, they simplify slab logistics.

Furthermore, an inspection system 18 for checking the slab quality, for example the surfaces of the slabs B, can be installed in spatial proximity, downstream of the casting machine 10.

Returning to FIG. 1, the device 1 further comprises a rolling mill 50, which is preferably a hot rolling mill. The rolling mill 50 has one or more rolling mill stands, preferably each of 4-high design with two working rolls forming the roll gap and two backup rolls, and can be operated in reversing mode or in tandem. The rolling mill 50 can be designed as a roughing mill and/or finishing mill. The transport path of the slabs B through the rolling mill 50 is along a transport line CLM, which can coincide with the transport line of the casting machine CLC (see FIGS. 3, 4*a*, 4*b*, 4*c*) or can differ therefrom (see FIGS. 4*d* and 4*e*).

In terms of process technology, between the casting machine 10 and the rolling mill 50 there is a combination of assemblies comprising, in accordance with the exemplary embodiment of FIG. 1, a surface device 20, a temperature-influencing device 30 and a combination transport and temperature-influencing device 40 (also abbreviated herein as "CTT"). The nature and spatial arrangement of the assemblies can vary, as shown in the following exemplary embodiments. The combination of the assemblies 20, 30, 40 is selected in such a manner that the device 1 enables the processing of different products, in particular both surface-sensitive products and temperature-sensitive products, along individual process steps, wherein the products are fed to the rolling process directly following the casting process, that is, in particular without intermediate storage of the products in a slab storage area.

In addition to the surface device 20, the temperature-influencing device 30 and the CTT 40, further assemblies may be arranged between the casting machine 10 and the rolling mill 50, for example further cutting devices, emergency roller tables, additional heating/cooling elements, thermal insulation hoods, general transport roller tables and the like. The arrangement of such assemblies/devices is preferably between the casting machine 10 and the CTT 40.

In the exemplary embodiment of FIG. 1, the surface device 20 and the temperature-influencing device 30 are arranged in parallel, thus forming alternative routes for the slabs B. Furthermore, a third route is provided, which acts as a bypass in that the slabs B bypass, that is, skip, both the surface device 20 and the temperature-influencing device 30 and can be introduced into the CTT 40 immediately following casting.

Figure 3:
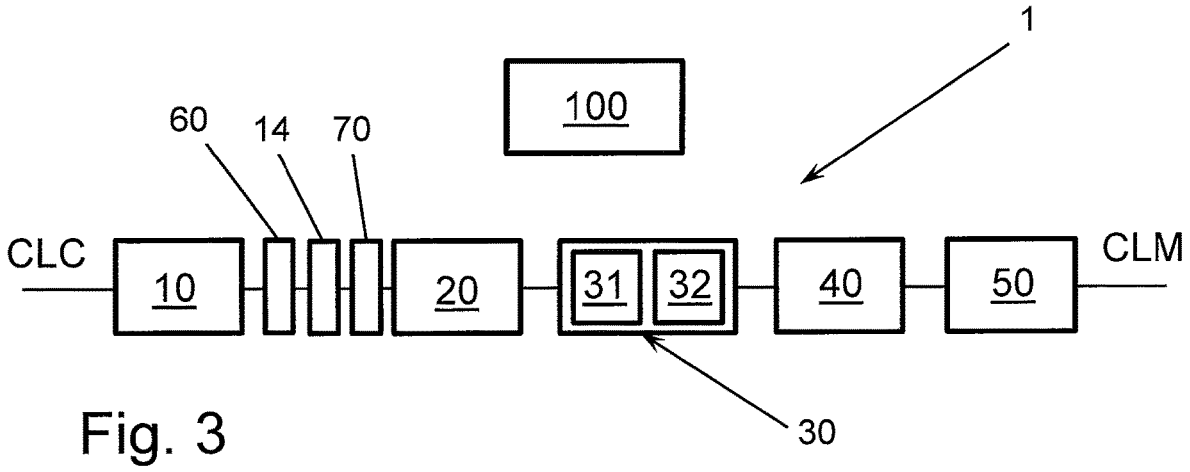
FIG. 3 a schematic illustration of a device for producing hot-rolled metal strip in accordance with a further exemplary embodiment.

FIG. 3 shows an alternative exemplary embodiment with which the surface device 20, the temperature-influencing device 30 and the CTT 40 are arranged in one and the same transport line. Furthermore, by way of example, an additional heating device 60, preferably in the form of an inductive heating element, is provided directly downstream of the outlet of the casting machine 10. This results in an additional flexibility advantage for temperature control, especially for slow cast slabs B. Furthermore, the cutting device 14 specified above can be installed as an assembly of the casting machine 10 or separately in the process line. A further cutting device 70 can be installed for emergencies/breakdowns in order to further divide and discharge a casting strand S exiting the casting machine.

A control device 100 is provided, which is in communication with the various assemblies 10, 20, 30, 40, 50, actuators, sensors and the like, and is designed to control process control as a function of process parameters, such as the alloy and temperature of the cast product.

A method for producing hot-rolled metal strips directly following the casting process, that is, without intermediate storage of the slabs B in a slab storage area, can comprise the following steps: a) producing a slab B with a predetermined alloy and dimension by means of the casting machine 10; b) transferring the slab B to the CTT 40; c) hot-rolling the slab B in the rolling mill 50 to form a strip. Thereby, the forming in the rolling mill 50 takes place at least partly from the casting heat, that is, there is no complete cooling of the slab B after casting on the way to the rolling mill 50. The above wording "directly following the casting process" thus means that there is no logistical removal of slab B to a slab storage area and that the slab temperature in its core preferably does not fall below 600° C. The slab is largely "in motion" throughout. The production sequence is dictated by the production cycles of the casting machine.

Between steps a) and b), further processing steps may be initiated in accordance with a signal from the control device 100. In other words, following the casting process, a routing decision can be made to transport the slab(s) B through the surface device 20, the temperature-influencing device 30, or bypassing both immediately into the CTT 40. The route decision can be made manually or automatically, for product batches or on an individual slab basis, for example depending on at least one measured or calculated process parameter. In the exemplary embodiment of FIG. 1, the route decision implies different transport routes at least in sections, while in the case of FIG. 3, the route decision relates solely to the selective processing of the slabs B or non-processing by the corresponding assemblies 20, 30, 40, etc. Alternatively or additionally, one or more of the assemblies 20, 30, 40 may be movable into or out of the process line as required.

The surface device 20 is a device for processing and/or treating and/or inspecting one or more surfaces of the slabs B.

For example, the surface device 20 can comprise material-removing surface finishing, which can be used, for example, to process products with special surface requirements. Such special requirements on product surfaces are made, for example, for use as an automotive outer skin, electrical steel strip or for optical applications. Alternatively or additionally, the surface device 20 can be designed to remedy any surface defects resulting from the casting process, such that they are removed before further process steps such as rolling take place. This means that, in such a case, it is a surface treatment that goes beyond mere scale removal.

Surface processing is performed on at least one surface of the slab B to be processed, wherein preferably both the top and bottom sides of the slab B as well as the longitudinal edges are processed. The material removal per surface is preferably in the range of 0 to 10 mm, particularly preferably 1 to 3 mm. The feed rate of the slab B can be in the range of 5 to 50 m/min. The surface processing preferably takes place at a slab surface temperature of greater than 600° C., particularly preferably greater than 900° C., such that no removal from storage and cooling of the slabs B in a slab storage area is required for the surface processing.

The surface device 20 is preferably a flame scarfing device, which is designed for the material-removing processing of the relevant surfaces of the slabs B. In accordance with an alternative exemplary embodiment, the surface device 20 can comprise a grinding device or milling device for machining one or more slab surfaces. Alternatively or additionally, the surface device 20 can comprise an inspection device, which is designed to detect surface properties of the slabs by means of contact or on a non-contact basis. The surface information determined in this way may be used by the control device 100 for further process control.

In terms of process technology, the surface device 20 is implemented without intermediate storage. With regard to the layout of the device 1, this can mean that the surface device 20 is arranged in the transport line of the casting machine CLC. Where appropriate, the surface device 20 can be designed to be removable from the process line when not in use. Alternatively, the surface device 20 can be arranged outside but close to the process line, such that the slab B is discharged from the process line for processing and then returned. Preferably, in such case, the slabs B are returned at a slab surface temperature of greater than 600° C.

The temperature-influencing device 30 preferably comprises a combination heating and cooling device with a heating device 31 and a cooling device 32.

The temperature-influencing device 30 is used in particular for producing crack-sensitive products, for example micro-alloyed steels. If such alloys are run into the CTT 40 immediately after the casting process, that is, in a certain temperature range, undesirable precipitation of microalloys in the layers close to the edges can occur, which can lead to cracking or other quality defects in subsequent steps. Such critical temperature range refers to the surface temperature of slab B and is referred to as $T_{kritisch}$ with a lower threshold value $T_u$ and an upper threshold value $T_o$. For a majority of crack-sensitive alloys, $T_u$ is approximately 600° C. and $T_o$ is approximately 850° C.

In such a case of crack-sensitive products, the temperature-influencing device 30 selectively heats or cools the slabs B passing through it so as to ensure that the slab surface temperature is outside the critical temperature range $T_{kritisch}$. For this purpose, the control device 100 controls either the heating device 31 or the cooling device 32 accordingly, such that the surface temperature of the slab B does not fall within the specified temperature window. This is preferably effected as a function of a measured or otherwise determined slab surface temperature. If the control device 100, possibly in cooperation with a corresponding sensor, determines that the slab surface temperature at the inlet of the temperature-influencing device 30 is above $T_o$ or below $T_u$, no temperature influencing by the temperature-influencing device 30 is necessary. If the slab surface temperature is within $T_{kritisch}$, the slab B is either heated or cooled by the temperature-influencing device 30, depending on the direction in which the slab B can reasonably be brought out of the temperature window $T_{kritisch}$. If both directions are possible, the heating of the slab B by the temperature-influencing device 30 is preferred.

The heating device 31 is preferably an inductive heating device, which enables the rapid and individual setting of the heating power with a compact design. Alternatively or additionally, a gas-powered or electric-powered continuous furnace can be applied.

The cooling device 32 is preferably designed to realize a rapid cooling of the slabs B by applying a cooling medium, preferably cooling water. The quantity of cooling water applied is preferably greater than 500 $m^3/h/m^2$, particularly preferably greater than 650 $m^3/h/m^2$, applied over a cooling section length of preferably 3 to 10 m, particularly preferably 4 to 6 m, such that a near-surface temperature reduction to a temperature below $T_u$ takes place at different slab speeds. "Near-surface" in this connection means a penetration depth of up to 15 mm from the slab surface. The exposure time of the cooling water is preferably less than 3 minutes. Alternatively or in addition to rapid cooling, laminar cooling or other cooling equipment can be installed.

One advantage of near-surface cooling is that the core temperature of slab B is not affected, or only slightly affected, whereas the surface temperature drops to a temperature at which cracking due to microprecipitation is avoided. The core temperature not being lowered or only slightly lowered facilitates subsequent reheating of slab B to the desired hot rolling temperature, whereby the required heating power and heating time can be minimized compared with heating a completely cooled slab B from a slab storage area. This results in significant energy savings.

The heating device 31 of the temperature-influencing device 30 is also advantageous for the production of Si steel, since the overall temperature can be maintained at a desired level and the temperature setting prior to hot rolling, which is to be set to ensure a final rolling temperature, is subject to less fluctuation. The aluminum nitrides precipitated on the surface during solidification of the slab B are brought back into solution and held there in order to precipitate them again in a targeted manner during hot rolling. The time required for dissolving the aluminum nitrides can thus be distributed between different aggregates, specifically the temperature-influencing device 30 and the CTT 40 described below, such that more flexible process control, a shorter system layout and shorter dwell times in the CTT 40 can be realized.

The combination transport and temperature-influencing device 40 is used to logistically feed the slabs B to the rolling mill 50 at the alloy-dependent temperature and temperature distribution required or desired in terms of process technology. The temperature influencing of the slabs B and the logistic transport take place simultaneously.

Depending on whether the slab B is conveyed directly from the casting machine 10 into the CTT 40 or whether intermediate process steps such as surface treatment and/or temperature influencing have taken place, an individual inlet temperature in the CTT 40 results. Thus, the heating power and/or dwell time of the slab B in the CTT 40 is preferably adaptable to maintain a temperature in the outlet of the CTT 40 that ensures the suitable rolling temperature in the inlet of the rolling mill 50.

The CTT 40 is controlled by the control device 100, which takes into account any process steps that may have been performed in advance.

The structure of the CTT 40 is preferably variable with regard to the type of temperature influencing and logistics. This is illustrated below on the basis of exemplary embodiments.

In a first, simple variant, the CTT 40 comprises a roller hearth furnace that performs both temperature equalization and transport of the slab B. The use of a roller hearth furnace can cause surface defects and/or running marks in the product due to accumulated scale on the furnace rollers, for which reason it can be advisable to consider alternative designs for the CTT 40, particularly with regard to crack-sensitive and/or surface-sensitive products.

Figure 4A:
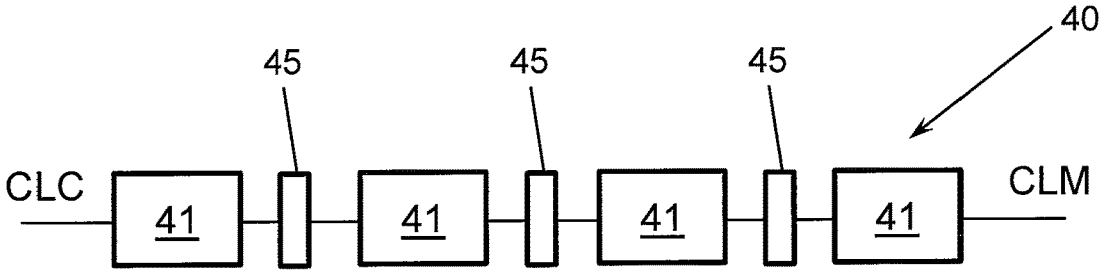
FIGS. 4*a* to 4*e* schematic illustrations of a combination transport and temperature-influencing device in accordance with different exemplary embodiments.

FIG. 4*a* shows such an alternative variant, with which the CTT 40 comprises a roller table 41 as a transport element, preferably with a thermal insulation device, in combination with at least one, preferably a plurality of inductive heating elements 45. The heating elements 45 may be integrated throughout the roller table. The arrangement of a plurality of inductive heating elements 45 makes it particularly easy to set the temperature individually.

The simple mechanical design variant shown in FIG. 4*a* permits a compact structure that is particularly suitable for a system configuration with which the transport line of the casting machine CLC and the transport line of the rolling mill CLM are the same. If the transport lines CLC, CLM of the casting machine 10 and the rolling mill 50 are identical, individual slabs B or an endless material to be rolled may be conveyed into the rolling mill 50.

Figure 4B:
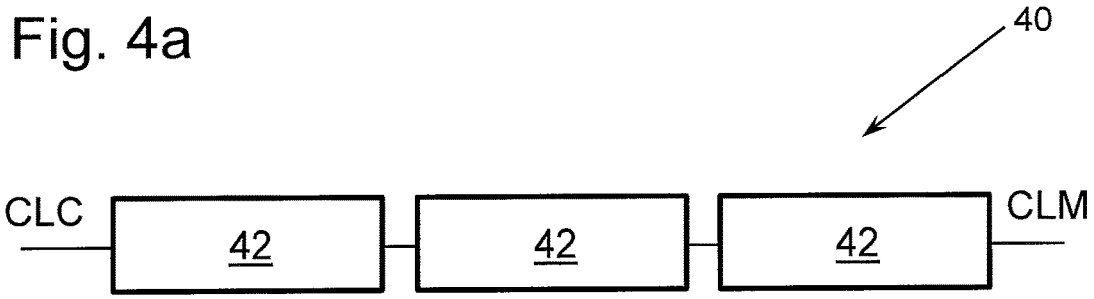

FIG. 4*b* shows a further variant, with which the CTT 40 comprises one or more walking beam furnaces 42 arranged one behind the other. Such a sequence of walking beam furnaces 42 allows a highly compact structure, preferably for system configurations with which the transport lines CLC, CLM of the casting machine 10 and the rolling mill 50 are the same. If the transport lines CLC, CLM are identical, individual slabs B or an endless material to be rolled may be conveyed into the rolling mill 50.

Figure 4C:
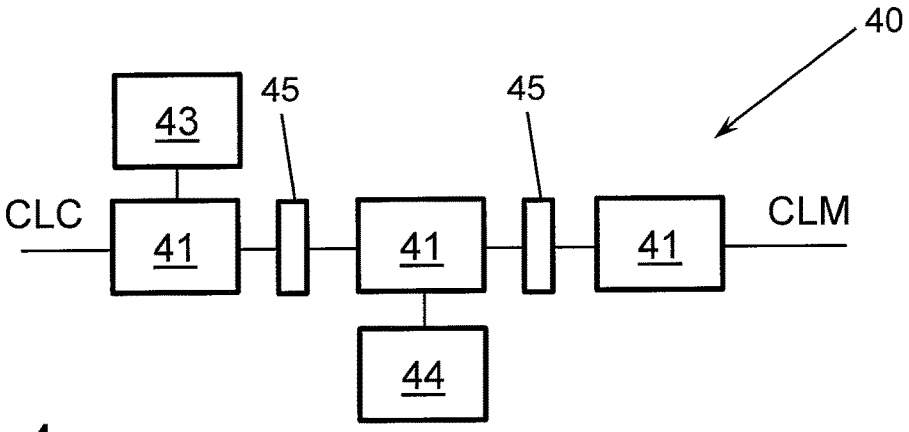

FIG. 4*c* shows a further variant, with which, starting from the design of FIG. 4*a*, one or more slab discharge device(s) and/or slab feed device(s) are installed transverse to the transport line CLC, CLM. This increases system flexibility in that not only can slabs B be fed to the rolling mill 50 directly following the casting process, but slabs B may also be discharged to another station, for example a slab storage area, or fed from another station, for example a slab storage area, into the transport line CLC, CLM. Furthermore, an emergency discharge can be carried out in this manner, for example in the event of a breakdown of the casting machine 10 or the rolling mill 50. The slab transport transverse to the conveying direction can be carried out, for example, via a slab ferry 43 and/or a corresponding roller table element 44. Such a possibility of feed and/or discharge of slabs B transverse to the transport line CLC, CLM is not only possible starting from the basic structure of FIG. 4*a*, but is generally implementable for any design of the CTT 40, for example starting from the design of FIG. 4*b*.

Figure 4D:
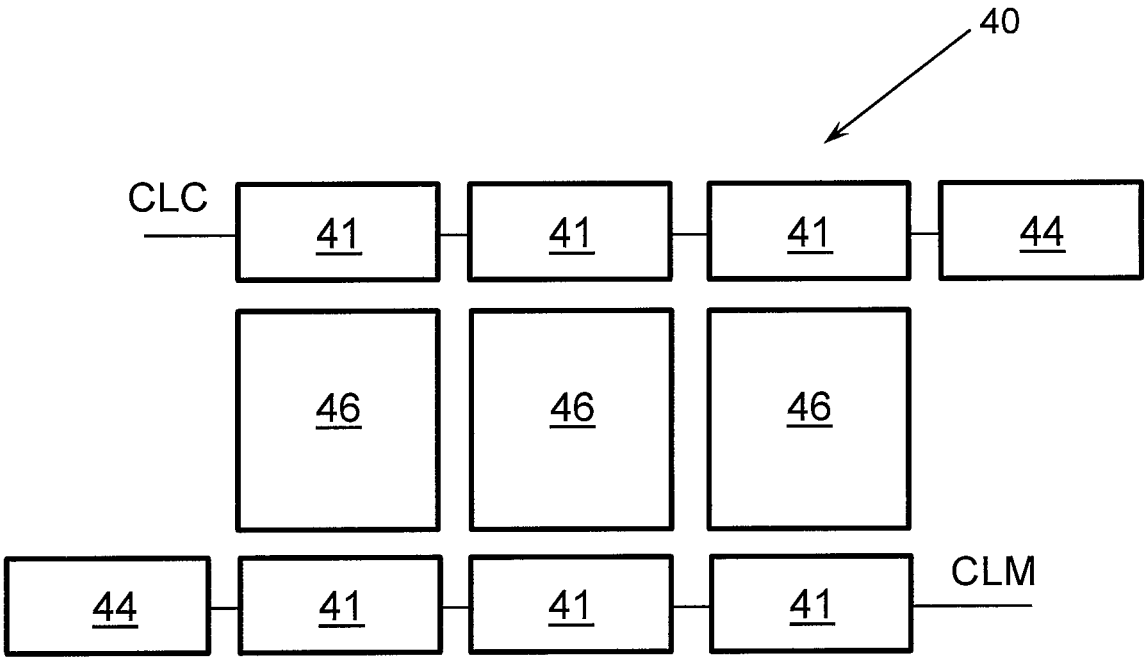
Figure 4E:
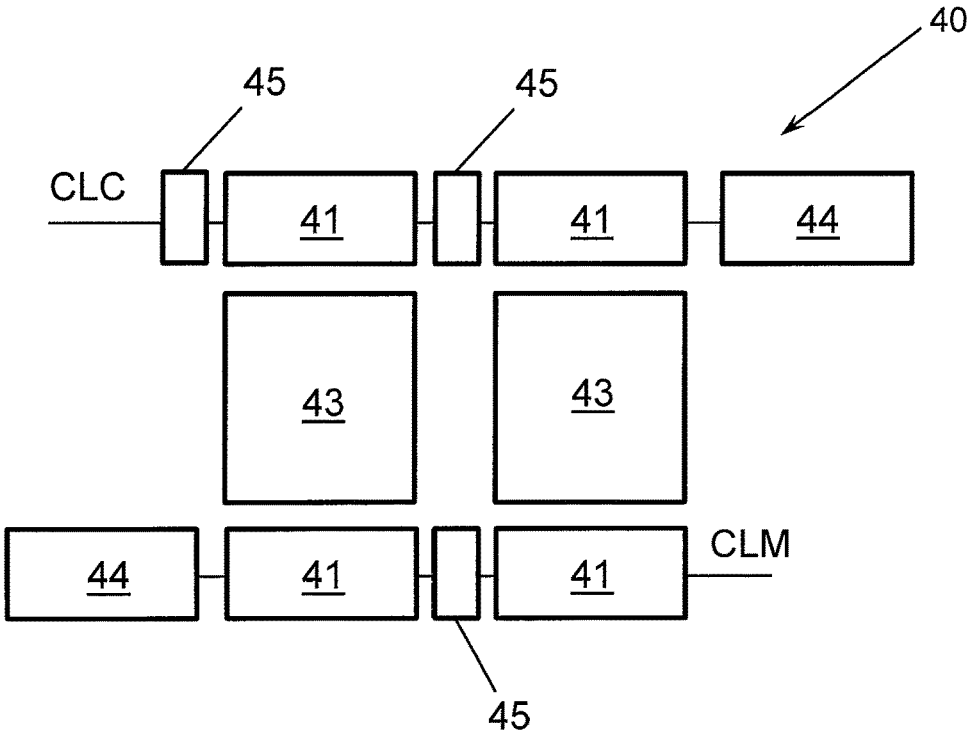

In accordance with a further variant of the CTT 40, the transport lines CLC, CLM of the casting machine 10 and the rolling machine 50 are not identical, but are spaced apart and parallel, as shown in the exemplary embodiments of FIGS. 4*d* and 4*e*. This enables a particularly compact design.

In accordance with the exemplary embodiment shown in FIG. 4*d*, the slabs B are transported in the respective transport lines CLC, CLM via a plurality of roller tables 41, if necessary with a thermal insulation device. The transport transverse to the transport lines CLC and CLM can be carried out via one or more walking beam furnaces 46. The walking beam furnaces 46 may be electric and/or gas-fired. Through a walking beam furnace 46, a transport and temperature influencing can simultaneously take place. When multiple walking beam furnaces 46 are used, the furnaces may vary in the operating ranges of their temperature levels and/or cycle times. This allows the dwell time of the slabs B in the walking beam furnaces 46 to be controlled individually.

In accordance with the variant shown in FIG. 4*e*, the transport and heating of the slabs B in the transport lines CLC and/or CLM is carried out via roller tables 41 with integrated heating elements 45, which are preferably inductive heating elements. The transport of the slabs B transverse to the transport lines CLC, CLM is carried out with the aid of one or more slab ferries 43.

The possible combinations of transport elements and heating elements in the CTT can be further combined as desired.

Based on the designs of FIGS. 4*d* and 4*e*, it is possible to install one or more slab discharge device(s) and/or slab feed device(s) along the transport lines CLC, CLM. This extends the system flexibility in that not only slabs B can be fed to the hot rolling mill 50 directly following the casting process, but also slabs B can be discharged to another station, for example a slab storage area, or entered from another station, for example a slab storage area, into the corresponding transport line CLC, CLM. Furthermore, an emergency discharge can be carried out in this manner, for example in the event of a breakdown of the casting machine 10 or the rolling mill 50. The slab transport transverse to the conveying direction can be carried out, for example, via a slab ferry 43 and/or a corresponding roller table element 44.

An exemplary configuration of the control device 100 is further described with reference to FIG. 5.

The control device 100 is connected in terms of signal technology to the components of the device 1 to be controlled and/or read out, thus in particular to the casting machine 10, the surface device 20, the temperature-influencing device 30, the CTT 40 and the rolling mill 50. Communication between the control device 100 and the system components to be controlled and/or read out can be wired or wireless, digital or analog. The control device 100 can receive and/or transmit corresponding signals (control signals, data, etc.) accordingly, wherein signal transport in one direction as well as in both directions falls under the term "communication" in this connection. Thereby, the control device 100 does not necessarily have to be realized by a central computing device or electronic control system; rather, decentralized and/or multi-level systems, control networks, cloud systems and the like are included. The controller can also be an integral component of a higher-level system control system, or can communicate with one.

The control device 100 preferably comprises one or more process models or at least an interface to one or more process models. For communication with the devices to be controlled or read out, as the case may be, it is irrelevant whether the required calculations are performed in a process model connected to the control device 100 and the calculations are communicated to the control device 100 or whether the control device 100 comprises the process model itself.

Figure 5:
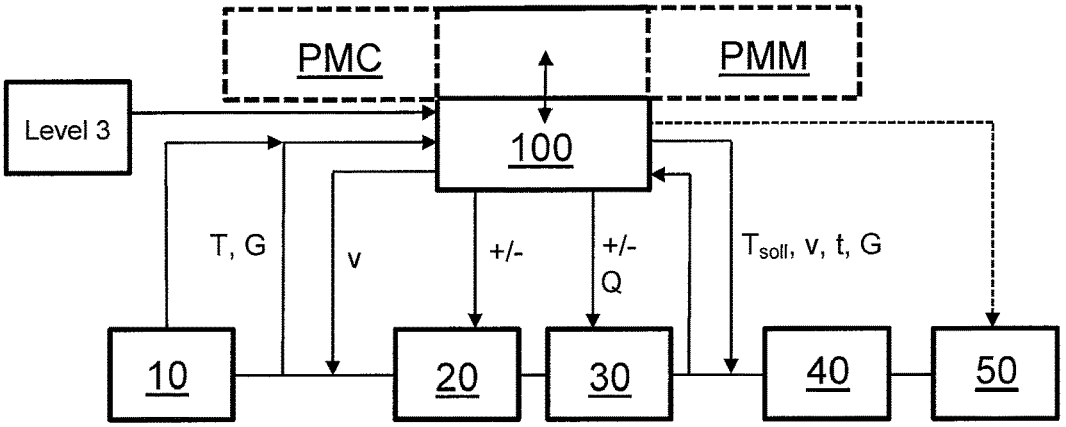
FIG. 5 a schematic illustration of the configurations, communication and operation of the control device 100 in accordance with one exemplary embodiment.

In the exemplary embodiment of FIG. 5, the control device 100 communicates with a process model of the casting machine PMC and a process model of the rolling mill PMM. The process models PMC, PMM may comprise overlapping sub-models, which preferably cover the region relevant for the control device 100 between the casting machine 10 and the rolling mill 50. Alternatively, only one of the specified regions can cover the relevant region or an independent sub-model can be implemented.

The control device 100 can communicate with system controls of lower levels, that is, controls associated with the corresponding facilities.

The control device 100 is designed to map the process control and process parameters from the casting machine 10 to the rolling mill 50. Thereby, relevant data, such as the slab temperature or final rolling temperature, from the process model of the casting machine PMC and the process model of the rolling mill PMM are communicated to the control device 100.

Data exchange with a production planning system or a process control planning system can facilitate the work of the control device 100 and automate the process control, the necessary calculations and the transmission of the control signals.

In the exemplary embodiment of FIG. 5, the control device 100 obtains a data set of a product to be produced from a process control planning system, for example a so-called "level 3 system," and thus receives information about the planned production steps and the final specifications of the finished product. Data is now present in the control device 100, which defines the production steps and affects the corresponding settings of the devices 10, 20, 30, 40, 50.

The settings of the casting machine 10 and the rolling mill 50 may be based on extensive technological/physical model calculations, such that information is available at the output of the casting machine 10, for example, about the slab alloy, slab geometry, slab temperature, slab speed and/or slab surface. The information may be obtained by calculation and/or measurement (for example, temperature measurement, surface inspection, etc.). The corresponding values/information are provided in the control device 100.

Taking into account the information provided by the casting machine 10, the control device 100 now determines the parameters required for further process control, in particular the slab speed downstream of the casting machine 10, and sets them on the relevant components.

The control device 100 determines whether to subject the slab B to processing and/or inspection in the surface device 20 and initiates such process, if necessary.

The control device 100 uses the transmitted slab temperature to calculate whether temperature influencing in the temperature-influencing device 30 is necessary for the alloy at hand. If such temperature influencing is required, the control device 100 calculates the setting of a corresponding cooling power or heating power of the temperature-influencing device 30 from the required heat flow.

The control device 100 calculates the slab temperature to be maintained at the end of the CTT 40 and related parameters such as slab speed, minimum dwell time in the CTT 40, possibly the heating power to be set based on the geometric dimensions, in particular thickness and length of the slab B, and the like.

If necessary, it may be necessary to feed further data from intermediate steps into the control device 100 as the basis for calculation, as illustrated by arrows in FIG. 5.

The device 1 for producing metal strips, in particular hot-rolled metal strips, illustrated herein can be used with a high degree of flexibility in terms of the product range and at the same time requires a minimum input of energy. Depending on the system layout, highly compact arrangements and/or production modes may be realized.

To the extent applicable, any of the individual features shown in the exemplary embodiments may be combined and/or interchanged without departing from the scope of the invention.

LIST OF REFERENCE SIGNS

1 Device for producing metal strips
10 Casting machine
11 Ingot mold
12 Strand guide
13 Rolls
14 Cutting device
16 Descaling device
17 Heating device
18 Inspection system
20 Surface device
30 Temperature-influencing device
31 Heating device
32 Cooling device
40 Combination transport and temperature-influencing device
41 Roller table
42 Walking beam furnace
43 Slab ferry
44 Roller table segment
45 Heating element
46 Walking beam furnace
50 Rolling mill
60 Additional heating device
70 Further cutting device
100 Control device
S Casting strand
B Slab
PMC Process model of the casting machine
PMM Process model of the rolling mill
CLC Transport line of the casting machine
CLM Transport line of the rolling mill

The invention claimed is:

1. A device (1) for producing rolled metal strips, comprising:

a casting machine (10), which is designed to produce and transport slabs (B) in a transport line of the casting machine (CLC);

a rolling mill (50), which is designed to form the slabs (B) into corresponding metal strips by rolling during transport along a transport line of the rolling mill (CLM);

a combination transport and temperature-influencing device (40), which is arranged between the casting machine (10) and the rolling mill (50), and which is designed to transport the slabs (B) to or along the transport line of the rolling mill (CLM), to feed the slabs (B) to the rolling mill (50) and to set the temperature of the slabs (B) to a rolling temperature;

a surface device (20), which is arranged between the casting machine (10) and the combination transport and temperature-influencing device (40), and which is designed to process and/or treat and/or inspect at least one of the surfaces of the slabs (B);

a temperature-influencing device (30), which is arranged between the casting machine (10) and the combination transport and temperature-influencing device (40), and which is designed to modify the temperature of the slabs (B), and a control device (100) for controlling the temperature-influencing device (30) to either heat or cool the slabs (B) as a function of a measured and/or calculated temperature of the slabs (B), wherein multiple routes are provided, which implement different process lines for the slabs (B), at least in sections, wherein the surface device (20) is arranged in a first route and the temperature-influencing device (30) is arranged in a second route and is designed in such a manner that the slabs (B) pass through either the surface device (20) or the temperature-influencing device (30), wherein the temperature-influencing device (30) comprises a combination heating and cooling device with a heating device (31) and a cooling device (32), the heating device (31) and the cooling device (32) being arranged in series whereby the slabs (B) that pass through the temperature-influencing device (30) pass through the heating device (31) and the cooling device (32), wherein the control device (100) is designed to control the temperature-influencing device (30) to either heat or cool slabs (B) such that a slab surface temperature before entering the combination transport and temperature-influencing device (40) is outside a critical temperature range ($T_{kritisch}$) defined by a lower threshold value ($T_u$) of 600° C. and an upper threshold value ($T_o$) of 850° C., and wherein the control device (100) is designed to not influence the temperature of the slab in case the slab surface temperature at an inlet of the temperature-influencing device (30) is above the upper threshold value ($T_o$) of 850° C. or below the lower threshold value ($T_u$) of 600° C.

2. The device (1) according to claim 1, wherein the heating device (31) comprises an inductive heating device and/or wherein the cooling device (32) is designed to realize a rapid cooling of the slabs (B) by applying a coolant.

3. The device (1) according to claim 1, wherein the surface device (20) is designed to process at least one surface of the slabs (B) by grinding and/or milling and/or scarfing.

4. The device (1) according to claim 1, wherein the combination transport and temperature-influencing device (40) comprises:

one or more roller tables (41); and/or one or more thermal insulation devices; and/or one or more inductive heating elements (45); and/or one or more furnaces (42, 46); and/or one or more slab discharge devices for discharging slabs (B) from the transport line of the casting machine (CLC) and/or transport line of the rolling mill (CLM); and/or one or more slab feed devices for feeding slabs (B) into the transport line of the casting machine (CLC) and/or transport line of the rolling mill (CLM).

5. The device (1) according to claim 1, wherein the transport line of the casting machine (CLC) and the transport line of the rolling mill (CLM) are different and run in parallel, wherein the combination transport and temperature-influencing device (40) is further designed to perform the transport of the slabs (B) from the transport line of the casting machine (CLC) into the transport line of the rolling mill (CLM).

6. The device (1) according to claim 1, wherein a third route is provided, along which the slabs (B) skip both the surface device (20) and the temperature-influencing device (30) and can thus be introduced immediately into the combination transport and temperature-influencing device (40).

7. The device (1) according to claim 1, wherein the rolling mill (50) is a hot rolling mill and is designed to form the slabs (B) at least partially from the casting heat of the casting machine (10).

8. The device (1) according to claim 1, wherein the control device (100) is designed to feed the slabs (B) cast by the casting machine (10) to the rolling mill (50) without intermediate storage in a slab storage area.

9. The device (1) according to claim 1, wherein the casting machine (10) is configured for casting medium slabs having a thickness in the range of 110 to 200 mm.

10. The device (1) according to claim 1, wherein the heating device (31) and the cooling device (32) form a common assembly.

11. The device (1) according to claim 1, wherein the multiple routes include a third route, and wherein the slabs (B) on the third route bypass the both the surface device (20) and the temperature-influencing device (30).

* * * * *